US010868355B2

(12) United States Patent
Qiu et al.

(10) Patent No.: US 10,868,355 B2
(45) Date of Patent: Dec. 15, 2020

(54) ANTENNA MODULE AND MOBILE TERMINAL

(71) Applicant: AAC Technologies Pte. Ltd., Singapore (SG)

(72) Inventors: Xiaojun Qiu, Shenzhen (CN); Bo Zhu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 7 days.

(21) Appl. No.: 16/525,590

(22) Filed: Jul. 30, 2019

(65) Prior Publication Data

US 2020/0058984 A1 Feb. 20, 2020

(30) Foreign Application Priority Data

Aug. 20, 2018 (CN) ..... 2018 1 0947841

(51) Int. Cl.
*H01Q 1/24* (2006.01)
*H01Q 5/328* (2015.01)
*H01Q 1/50* (2006.01)

(52) U.S. Cl.
CPC ..... *H01Q 1/243* (2013.01); *H01Q 1/50* (2013.01); *H01Q 5/328* (2015.01)

(58) Field of Classification Search
CPC ..... H01Q 9/42; H01Q 1/243; H01Q 1/38; H01Q 21/28; H01Q 1/50; H01Q 9/04; H01Q 1/521; H01Q 3/24; H01Q 13/10; H01Q 13/103; H01Q 1/2291; H01Q 21/00; H01Q 21/0006; H01Q 21/12; H01Q 21/29; H01Q 3/34; H01Q 5/00; H01Q 5/22; H01Q 5/371; H01Q 5/40; H01Q 5/48; H01Q 9/0442; H01Q 9/145; H01Q 9/16; H01Q 9/28; H01Q 9/30; H01Q 9/40; H01Q 1/1228; H01Q 1/2283; H01Q 13/24; H01Q 19/08; H01Q 1/04; H01Q 1/12; H01Q 1/246; H01Q 1/44; H01Q 21/067; H01Q 21/205; H01Q 3/08; H01Q 3/10; H01Q 3/20; H01Q 3/26; H01Q 3/46; H01Q 19/09; H01Q 3/44; H01Q 5/335; H01Q 7/00; H01Q 1/007; H01Q 1/088; H01Q 1/103; H01Q 1/1207; H01Q 21/0025; H01Q 21/065; H01Q 25/005; H01Q 5/328; H01Q 9/06; H01Q 1/02; H01Q 1/364; H01Q 1/48; H01Q 1/523; H01Q 1/526; H01Q 21/24;
(Continued)

(56) References Cited

U.S. PATENT DOCUMENTS

2015/0270608 A1* 9/2015 Sub Shin ..... H01Q 1/243 343/722

* cited by examiner

*Primary Examiner* — Monica C King
(74) *Attorney, Agent, or Firm* — W&G Law Group LLP

(57) ABSTRACT

An antenna module includes a first antenna and a second antenna. The first antenna forms multiple operating states. By switching the multiple operating states, the first antenna supports an LTE low frequency of 698-960 MHz and an LTE medium-high frequency of 1710-2690 MHz, and supports multi-carrier aggregation in the band. In each operating state, the first antenna also operates in 5G bands of 3300-3800 MHz and 4800-5000 MHz, the second antenna operates in 5G bands of 3300-3800 MHz and 4800-5000 MHz and a new TDD-LTE band of 5150-5925 MHz. The first antenna and the second antenna together form a 2×2 MIMO of 5G bands of 3300-3800 MHz and 4800-5000 MHz. The antenna module provided by the disclosure has better communication performance.

18 Claims, 6 Drawing Sheets

(58) Field of Classification Search
CPC ..... H01Q 21/26; H01Q 25/001; H01Q 3/01;
H01Q 3/14; H01Q 3/40; H01Q 5/20;
H01Q 5/30; H01Q 5/35; H01Q 5/47;
H01Q 9/0414
See application file for complete search history.

ANTENNA MODULE AND MOBILE TERMINAL

TECHNICAL FIELD

The present disclosure relates to the field of antenna technologies, and in particular, to an antenna module and a mobile terminal.

BACKGROUND

The fifth-generation mobile communication is drawing near. 5G time of China's three major operators has also been determined. The Sub 6G bands of 3.3-3.6 GHz and 4.8-5 GHz band in the 5G released by the Ministry of Industry and Information Technology of China will be used in antenna bands of mobile phones. Mobile phone MIMO antenna designs in the future 5G era will definitely need to cover these bands. In addition to considering the design of antenna bands, a hardware layout of multi-carrier aggregation needs to be considered as well. Regarding to the concern about how the antenna should be designed to support use of multi-carrier aggregation (CA), bandwidth is a difficult point in design. The low frequency band of the mobile phone antenna in the 4G era is 698-960 MHz and it is required to be changed to 617 MHz-960 MHz in the 5G era, while for the medium-high frequency band, Sub 6G bands need to be added in addition to an original band of 1710 MHz-2690 MHz, which also means that an antenna bandwidth should be wide enough when so many bands, as well as use of multi-carrier aggregation (CA), need to be considered. However, in view of today's popular full-screen mobile phone environment, environment and space of antennas themselves are poor, and most of them need to match switching of tunable devices to be used for frequency expanding. Moreover, simultaneous use of MIMO and CA needs to be considered in certain bands, which is bound to increase the difficulty of antenna design.

Therefore, it is necessary to provide a new antenna module to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
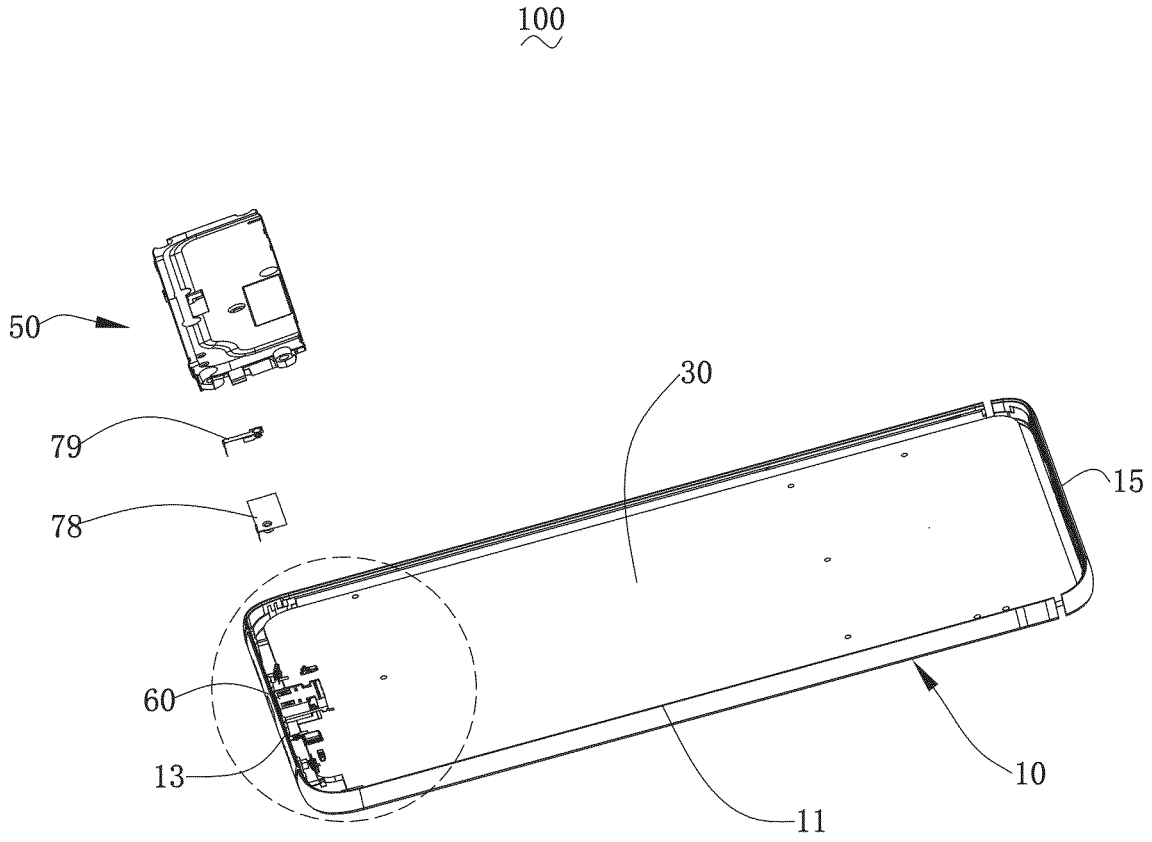
FIG. 1 is a partial exploded perspective structural schematic diagram of a preferred embodiment of a mobile terminal of the present disclosure.
Figure 2:
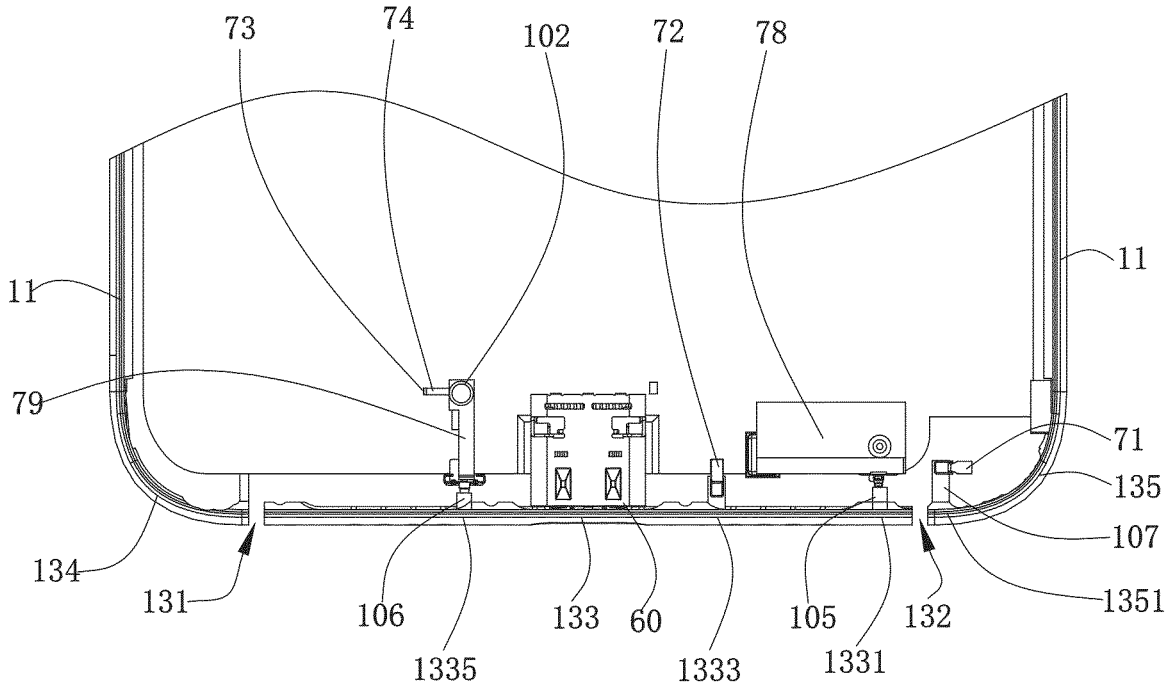
FIG. 2 is a partial structural schematic diagram of the mobile terminal shown in FIG. 1.
Figure 3:
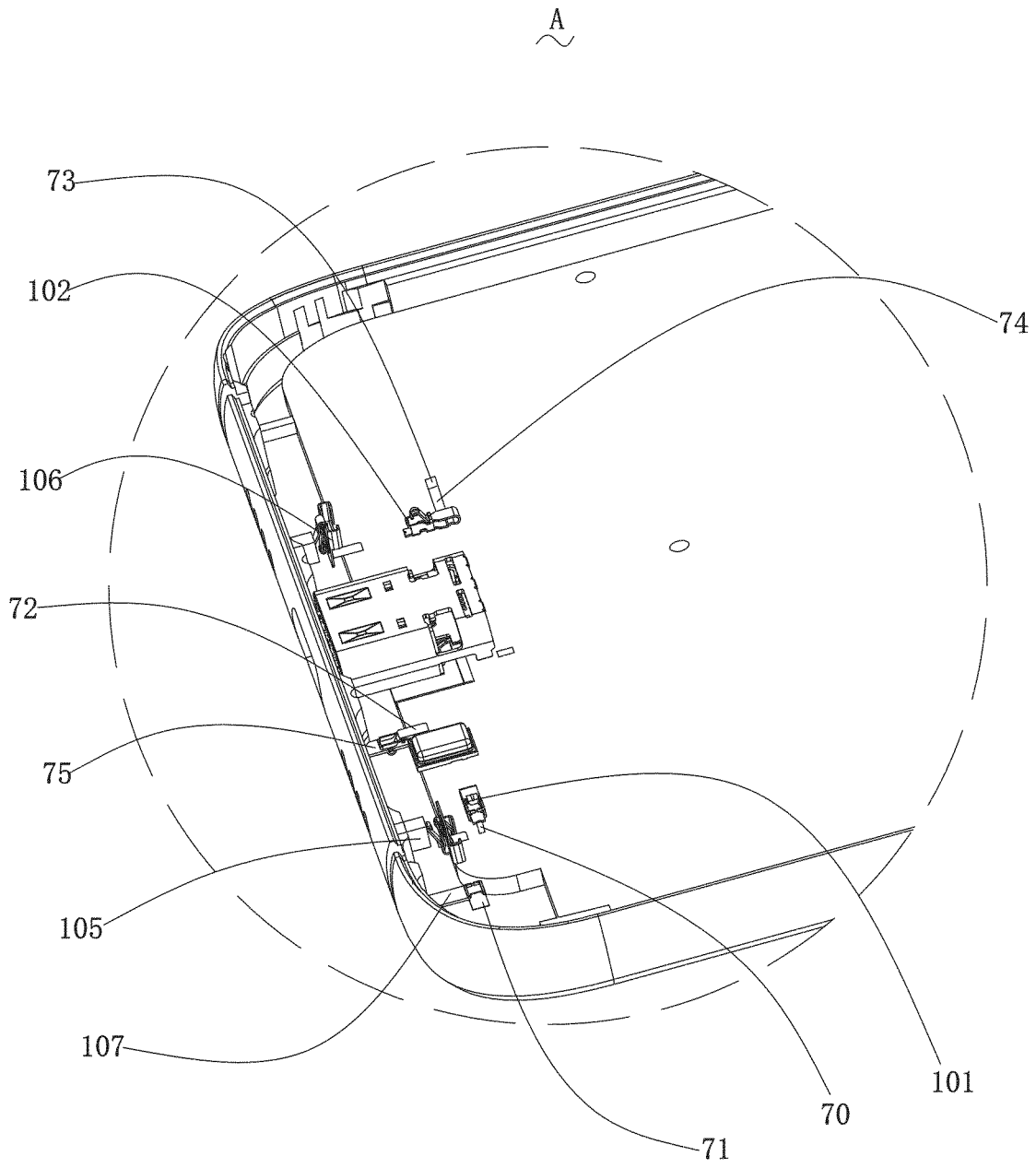
FIG. 3 is an enlarged structural schematic diagram of a portion A shown in FIG. 1.
Figure 4:
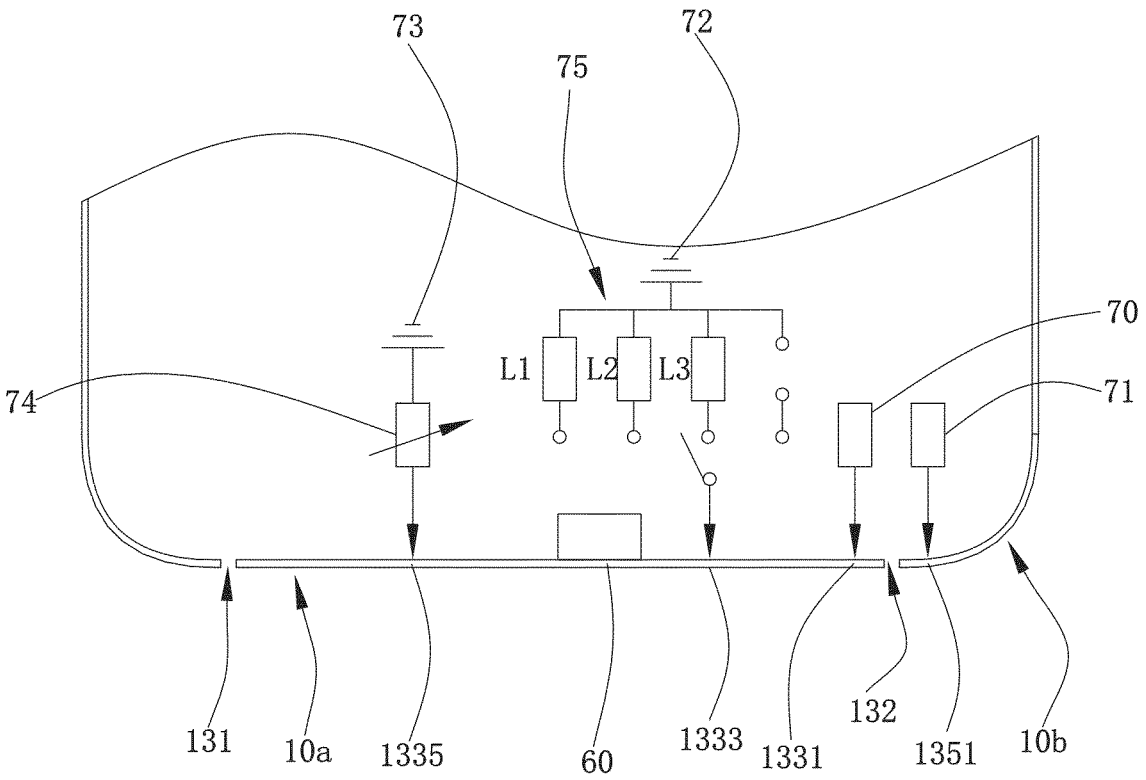
FIG. 4 schematically illustrates a circuit connection structure of a specific embodiment of an antenna module of the mobile terminal shown in FIG. 1.

The present disclosure will be further illustrated with reference to the accompanying drawings and the embodiments.

As shown in FIG. 1 to FIG. 4, an embodiment of the present disclosure provides a mobile terminal 100, which may be a mobile phone, a tablet computer, a multimedia player, etc. For ease of understanding, the following embodiments will be described by taking a smart mobile phone as an example.

The mobile terminal 100 includes a metal frame 10, a main board 30 received in the metal frame 10, a plastic bracket 50 that is provided on and covering the main board 30, a USB module 60 and an antenna module that are provided on the main board 30. The plastic bracket 50 is provided close to the bottom of the mobile terminal 100.

The metal frame 10 includes two middle frames 11 arranged opposite to each other, a bottom frame 13 and a top frame 15 that are respectively provided at two ends of the middle frames 11 and connected to the middle frames 11, respectively. The top frame 15, one of the middle frames 11, the bottom frame 13 and the other one of the middle frames 11 are sequentially connected to form the metal frame 10.

The bottom frame 13 is provided with a first slit 131 and a second slit 132. The first slit 131 and the second slit 132 divide the bottom frame 13 into a main frame 133 located in the middle, and a left frame 134 and a right frame 135 that are provided on two sides of the main frame 133. Two ends of the left frame 134 are respectively connected to the first slit 131 and one of the middle frames 11. Two ends of the right frame 135 are respectively connected to the second slit 132 and the other one of the middle frames 11. Specifically, the left frame 134 and the right frame 135 are symmetrically provided about a central axis of the mobile terminal in a width direction, such that the left frame 134 and the right frame 135 can be considered as arc-shaped corners connecting the main frame 133 with the middle frames 11, wherein the left frame 134 is a left-side corner and the right frame 135 is a right-side corner.

The antenna module includes a first feeding point 70, a second feeding point 71, a first ground point 72, a second ground point 73, and an adjustable capacitor (Tunner) 74, and a tuning switch (SW) 75 that are provided on the main board 30, and a first antenna pattern 78 and a second antenna pattern 79 that are provided on a surface of the plastic bracket 50 facing away from the main board 30. The first antenna pattern 78 and the second antenna pattern 79 are lasered on a surface of the plastic bracket 50 facing away from the main board 30 by an LDS process.

The first radiation portion 10*a* includes a main frame 133, a first antenna pattern 78, and a second antenna pattern 79. One end of the first antenna pattern 78 is connected to the first feeding point 70 and the other end thereof is connected to the main frame 133. The main frame 133 is connected to the first ground point 72 through the tuning switch 75. One end of the second antenna pattern 79 is connected to the main frame 133 and the other end thereof is connected to the second ground point 73 through the adjustable capacitor 74 to form a first antenna. The first antenna is of an IFA antenna type. The adjustable capacitor 74 is a key component of the first antenna frequency expanding, and with help of the different connected states of the tuning switch 75 and the change in capacitance value itself, multiple operating states can be formed. By switching the multiple operating states, the first antenna can support an LTE low frequency of 698-960 MHz and an LTE medium-high frequency of 1710-

2690 MHz, and supports multi-carrier aggregation in the band; in each of the operating states, the first antenna also operates in 5G bands of n78 (3300-3800 MHz) and n79 (4800-5000 MHz).

The right frame 135 is provided as a second radiation portion 10*b* of the antenna module, and the right frame 135 is grounded through the middle frame 11 connected thereto. Specifically, the middle frame 11 is grounded by being connected to the metal middle frame of the mobile terminal 100. The second feeding point 71 is connected to the right frame 135 to form a second antenna. The right frame 135 is directly connected to the middle frame 11 to form an antenna design of a "loop antenna". The second antenna supports 5G bands of n78 (3300-3800 MHz) and n79 (4800-5000 MHz) and can also support a new TDD-LTE band of B46 (5150-5925 MHz). Moreover, the second antenna and the first antenna together form a 2×2 MIMO of 5G bands of n78 (3300-3800 MHz) and n79 (4800-5000 MHz).

The first antenna pattern 78 is connected at a first position 1331 of the main frame 133. The second feeding point 71 is connected at a second position 1351 of the right frame 135. The first ground point 72 is connected at a third position 1333 of the main frame 133. The second antenna pattern 79 is connected at a fourth position 1335 of the main frame 133. The first position 1331 and the second position 1351 are provided on two sides of the second slit 132 and provided close to the second slit 132. The third position 1333 and the fourth position 1335 are provided on two sides of the USB module 60, and the third position 1333 is located between the USB module 60 and the first position 1331.

In the present embodiment, the first feeding point 70 and the second ground point 73 are provided on a surface of the printed circuit board 30 facing towards the plastic bracket 50. The first ground point 72 and the second feeding point 71 are provided on a surface of the printed circuit board 30 facing away from the plastic bracket 50.

Preferably, the antenna module further includes a first elastic piece 101 that is provided on a surface of the printed circuit board 30 facing towards the plastic bracket 50 and connected to the first feeding point 70, a second elastic piece 102 connected to the adjustable capacitor 74. Specifically, one end of the first elastic piece 101 is connected to the first feeding point 70 and the other end is connected to the first antenna pattern 78. One end of the second elastic 102 is connected to the adjustable capacitor 74 and the other end is connected to the second antenna pattern 79.

Preferably, the antenna module further includes a third elastic piece 105 and a fourth elastic piece 106 that abut against the main frame 131, and a fifth elastic piece 107 abutting against the right frame 135. The main frame 133 is connected to the first antenna pattern 78 through the third elastic piece 105. The main frame 133 is connected to the second antenna pattern 79 through the fourth elastic piece 106. The right frame 135 is connected to the second feeding point 71 through the fifth elastic piece 107.

In the present embodiment, the tuning switch 75 is provided with a first inductor-connected state, a second inductor-connected state, a third inductor-connected state, and an open-circuit state. Specifically, when the tuning switch 75 is in the first inductor-connected state, the first radiation portion 10*a* is connected to the first ground point 72 through a first inductor L1; when the tuning switch 75 is in the second inductor-connected state, the first radiation portion 10*a* is connected to the first ground point 72 through a second inductor L2; when the tuning switch 75 is in the third inductor-connected state, the first radiation portion 10*a* is connected to the first ground point 72 through a third inductor L3; the first radiation portion 10*a* is electrically isolated from the first ground point 72 when the tuning switch 75 is in an open-circuit state. The values of the first inductor, the second inductor and the third inductor are 3 nH, 4.3 nH and 6.2 nH, respectively.

The antenna module covers different bands by adjusting the adjustable capacitor 74 (Tunner) and the tuning switch 75 (SW) of the first antenna. Referring to the table below for details.

TABLE 1

| State | SW | Tunner | Coverage Band |
|---|---|---|---|
| State 1 | 3 nH | 0.4 pf | 910-960 MHz, 3300-3380 MHz (n78), 4800-5000 MHz(n79), 5150-5925 MHz (TDD-LTE B46) |
| State 2 | 3 nH | 0.6 pf | 880-930 MHz, 3300-3380 MHz (n78), 4800-5000 MHz (n79), 5150-5925 MHz (TDD-LTE B46) |
| State 3 | 4.3 nH | 0.5 pf | 840-894 MHz, 2010-2020 MHz, 3300-3380 MHz (n78), 4800-5000 MHz (n79), 5150-5925 MHz (TDD-LTE B46) |
| State 4 | 4.3 nH | 0.7 pf | 824-863 MHz, 3300-3380 MHz (n78), 4800-5000 MHz (n79), 5150-5925 MHz (TDD-LTE B46) |
| State 5 | 6.2 nH | 0.5 pf | 791-832 MHz, 3300-3380 MHz (n78), 4800-5000 MHz (n79), 5150-5925 MHz (TDD-LTE B46) |
| State 6 | 6.2 nH | 0.8 pf | 740-803 MHz, 3300-3380 MHz (n78), 4800-5000 MHz (n79), 5150-5925 MHz (TDD-LTE B46) |
| State 7 | 6.2 nH | 1.2 pf | 703-760 MHz, 3300-3380 MHz (n78), 4800-5000 MHz (n79), 5150-5925 MHz (TDD-LTE B46) |
| State 8 | Open | 0.3 pf | 1710-2690 MHz, 3300-3380 MHz (n78), 4800-5000 MHz (n79), 5150-5925 MHz (TDD-LTE B46) |

Figure 5:
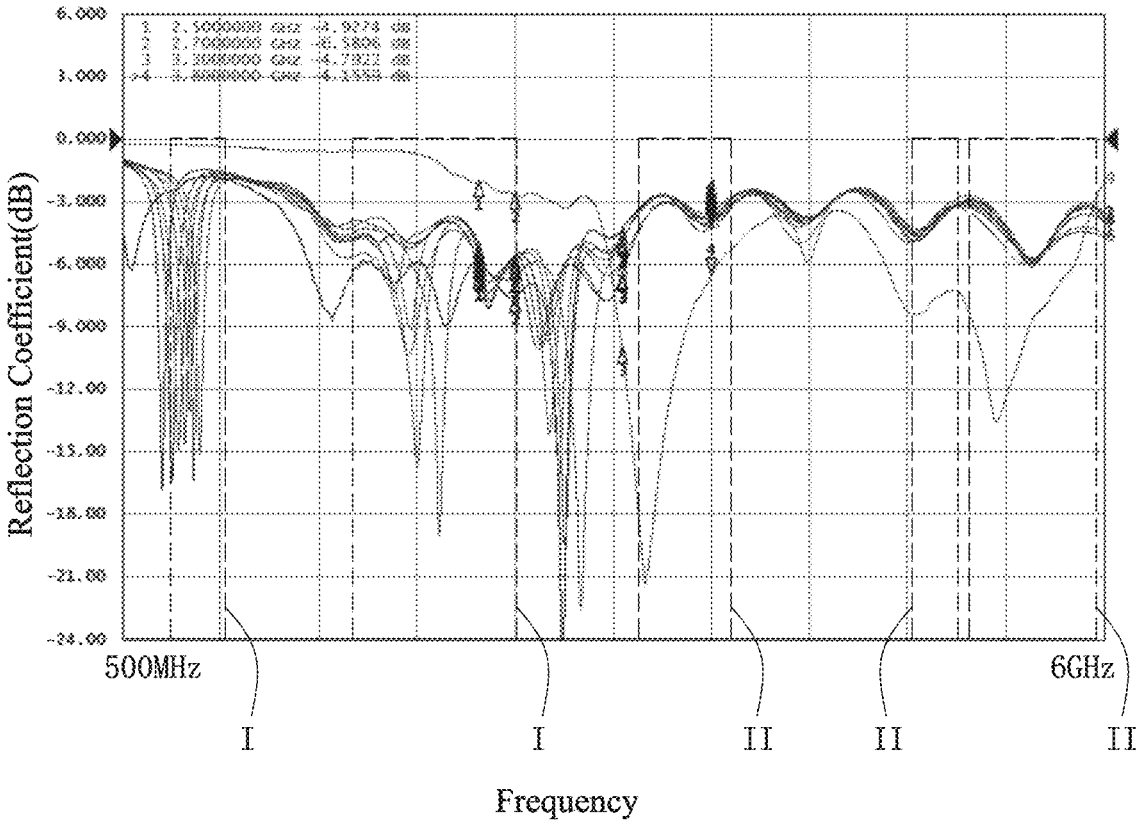
FIG. 5 illustrates a simulation result graph of return loss of an antenna module of a mobile terminal provided by the present disclosure.
Figure 6:
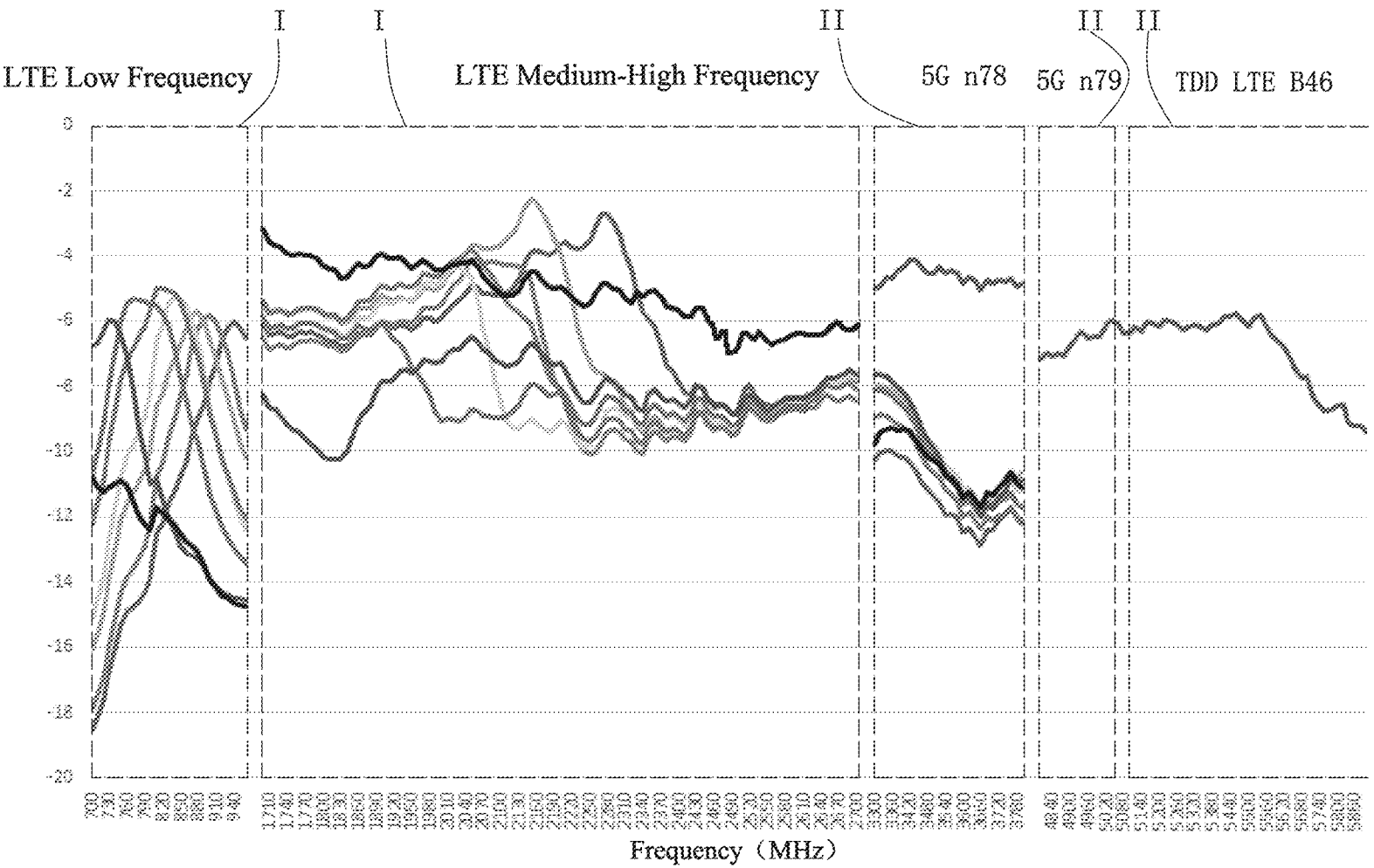
FIG. 6 illustrates a simulation result graph of radiation efficiency of an antenna module of a mobile terminal provided by the present disclosure.

As can be seen from the above table, the second antenna always supports bands of n78 (3300-3380 MHz), n79 (4800-5000 MHz) and B46 (5150-5925 MHz) regardless of the state of the first antenna. Referring to FIG. 5 and FIG. 6 in conjunction, the I region in FIG. 7 and FIG. 8 illustrates a simulation result of the return loss of the first antenna in the eight states in the above table, and the II region illustrates a simulation result of the return loss of the second antenna. It can also be seen from FIG. 5 and FIG. 6 that when the first antenna is switched between State 1 through State 8, the second antenna always supports bands of n78 (3300-3380 MHz), n79 (4800-5000 MHz) and B46 (5150-5925 MHz).

Compared with the related art, the first antenna of the antenna module provided by the present disclosure includes a tuning switch and an adjustable capacitor and is controlled by the tuning switch and the adjustable capacitor to form multiple operating states. By switching the multiple operating states, the first antenna supports an LTE low frequency of 698-960 MHz and an LTE medium-high frequency of 1710-2690 MHz and supports multi-carrier aggregation in the band; in each of the operating states, the first antenna also operates in 5G bands of 3300-3800 MHz and 4800-5000 MHz, and the second antenna operates in 5G bands of 3300-3800 MHz and 4800-5000 MHz and a new TDD-LTE band of 5150-5925 MHz, and together with the first antenna, form a 2×2 MIMO of 5G bands of 3300-3800 MHz and 4800-5000 MHz. The antenna module provided by the disclosure not only achieves multi-carrier aggregation in LTE low frequency and LTE medium-high frequency, but also achieves a 2×2 MIMO of 5G bands of n78 and n79, and simultaneously supports a TDD-LTE band of B46, such that the communication performance is better.

What have been described above are only embodiments of the present disclosure, and it should be noted herein that one ordinary person skilled in the art can make improvements without departing from the inventive concept of the present disclosure, but these are all within the scope of the present disclosure.

What is claimed is:

1. An antenna module, comprising:

a first antenna, the first antenna comprising a tuning switch and an adjustable capacitor and configured to be controlled by the tuning switch and the adjustable capacitor to form a plurality of operations states, and by switching between the plurality of operating states, the first antenna supporting an LTE low frequency of 698-960 MHz and an LTE medium-high frequency of 1710-2690 MHz and supporting multi-carrier aggregation, and a second antenna, wherein in each of the plurality of operating states, the first antenna further operates in 5G bands of 3300-3800 MHz and 4800-5000 MHz, the second antenna operates in 5G bands of 3300-3800 MHz and 4800-5000 MHz and a new TDD-LTE band of 5150-5925 MHz, and wherein the first antenna and the second antenna together form a 2×2 MIMO of 5G bands of 3300-3800 MHz and 4800-5000 MHz.

2. The antenna module as described in claim 1, wherein the antenna module is applied to a mobile terminal, and the mobile terminal comprises a metal frame, a main board received in the metal frame, and a plastic bracket that is provided on and covering the main board;

the metal frame comprises two middle frames arranged opposite to each other and a bottom frame connecting the two middle frames, the bottom frame is provided with a first slit and a second slit, the first slit and the second slit divide the bottom frame into a main frame located in a middle position and a left frame and a right frame that are respectively provided on two sides of the main frame;

the antenna module comprises a first feeding point, a second feeding point, a first ground point, a second ground point, the adjustable capacitor and the tuning switch that are provided on the main board, and a first antenna pattern and a second antenna pattern that are provided on a surface of the plastic bracket facing away from the main board;

a first radiation portion comprises the main frame, the first antenna pattern and the second antenna wiring, one end of the first antenna pattern is connected to the first feeding point and the other end thereof is connected to the main frame, the main frame is connected to the first ground point through the tuning switch, one end of the second antenna pattern is connected to the main frame and the other end thereof is connected to the second ground point through the adjustable capacitor, to form a first antenna;

a second radiation portion is the right frame, the second radiation portion is grounded through the middle frame connected thereto, and the second feeding point is connected to the second radiation portion, to form a second antenna.

3. The antenna module as described in claim 2, wherein the first antenna pattern is connected at a first position of the main frame, the second feeding point is connected at a second position of the right frame, and the first position and the second position are both provided close to the second slit.

4. The antenna module as described in claim 3, wherein the first ground point is connected at a third position of the main frame, the second antenna pattern is connected at a fourth position of the main frame, the mobile terminal further comprises a USB module, the third position and the fourth position are respectively provided on two sides of the USB module, and the third position is located between the USB module and the first position.

5. The antenna module as described in claim 2, wherein the tuning switch is provided with a first inductor-connected state, a second inductor-connected state, a third inductor-connected state, and an open-circuit state, and when the tuning switch is in different operating states, the first radiation portion is electrically connected to the first ground point or electrically isolated from the first ground point by one of a first inductor, a second inductor and a third inductor.

6. The antenna module as described in claim 2, wherein the first feeding point and the second ground point are provided on a surface of a circuit board facing towards the plastic bracket, and the antenna module further comprises a first elastic piece provided on a surface of the circuit board facing towards the plastic bracket and connected to the first feeding point and a second elastic piece connected to the adjustable capacitor.

7. The antenna module as described in claim 6, further comprising a third elastic piece and a fourth elastic piece that abut against the main frame, and a fifth elastic piece abutting against the right frame, the main frame is connected to the first antenna pattern through the third elastic piece, the main frame is connected to the second antenna pattern through the fourth elastic piece, and the right frame is connected to the second feeding point through the fifth elastic piece.

8. The antenna module as described in claim 6, wherein the first ground point and the second feeding point are provided on a surface of the circuit board facing away from the plastic bracket.

9. The antenna module as described in claim 2, wherein the first antenna pattern and the second antenna pattern are lasered on a surface of the plastic support facing away from the main board by a laser direct structuring (LDS) process.

10. A mobile terminal, comprising the antenna module as described in claim 1.

11. The mobile terminal as described in claim 10, wherein the antenna module is applied to a mobile terminal, and the mobile terminal comprises a metal frame, a main board received in the metal frame, and a plastic bracket that is provided on and covering the main board;

the metal frame comprises two middle frames arranged opposite to each other and a bottom frame connecting the two middle frames, the bottom frame is provided with a first slit and a second slit, the first slit and the second slit divide the bottom frame into a main frame located in a middle position and a left frame and a right frame that are respectively provided on two sides of the main frame;

the antenna module comprises a first feeding point, a second feeding point, a first ground point, a second ground point, the adjustable capacitor and the tuning switch that are provided on the main board, and a first antenna pattern and a second antenna pattern that are provided on a surface of the plastic bracket facing away from the main board;

a first radiation portion comprises the main frame, the first antenna pattern and the second antenna wiring, one end of the first antenna pattern is connected to the first feeding point and the other end thereof is connected to the main frame, the main frame is connected to the first ground point through the tuning switch, one end of the second antenna pattern is connected to the main frame and the other end thereof is connected to the second ground point through the adjustable capacitor, to form a first antenna; a second radiation portion is the right frame, the second radiation portion is grounded through the middle frame connected thereto, and the second feeding point is connected to the second radiation portion, to form a second antenna.

12. The mobile terminal as described in claim 11, wherein the first antenna pattern is connected at a first position of the main frame, the second feeding point is connected at a second position of the right frame, and the first position and the second position are both provided close to the second slit.

13. The mobile terminal as described in claim 12, wherein the first ground point is connected at a third position of the main frame, the second antenna pattern is connected at a fourth position of the main frame, the mobile terminal further comprises a USB module, the third position and the fourth position are respectively provided on two sides of the USB module, and the third position is located between the USB module and the first position.

14. The mobile terminal as described in claim 11, wherein the tuning switch is provided with a first inductor-connected state, a second inductor-connected state, a third inductor-connected state, and an open-circuit state, and when the tuning switch is in different operating states, the first radiation portion is electrically connected to the first ground point or electrically isolated from the first ground point by one of a first inductor, a second inductor and a third inductor.

15. The mobile terminal as described in claim 11, wherein the first feeding point and the second ground point are provided on a surface of a circuit board facing towards the plastic bracket, and the antenna module further comprises a first elastic piece provided on a surface of the circuit board facing towards the plastic bracket and connected to the first feeding point and a second elastic piece connected to the adjustable capacitor.

16. The mobile terminal as described in claim 15, further comprising a third elastic piece and a fourth elastic piece that abut against the main frame, and a fifth elastic piece abutting against the right frame, the main frame is connected to the first antenna pattern through the third elastic piece, the main frame is connected to the second antenna pattern through the fourth elastic piece, and the right frame is connected to the second feeding point through the fifth elastic piece.

17. The mobile terminal as described in claim 15, wherein the first ground point and the second feeding point are provided on a surface of the circuit board facing away from the plastic bracket.

18. The mobile terminal as described in claim 11, wherein the first antenna pattern and the second antenna pattern are lasered on a surface of the plastic support facing away from the main board by a laser direct structuring (LDS) process.

* * * * *